US010730648B2

(12) United States Patent
Lischkowitz et al.

(10) Patent No.: US 10,730,648 B2
(45) Date of Patent: Aug. 4, 2020

(54) DEVICE AND METHOD FOR PRODUCING FASCINES

(71) Applicant: Roess Nature Group GmbH & Co. KG, Twistringen (DE)

(72) Inventors: Henner Lischkowitz, Holtorf (DE); Thomas Roess, Twistringen (DE)

(73) Assignee: ROESS NATURE GROUP GMBH & CO. KG, Twistringen (DE)

( * ) Notice: Subject to any disclaimer, the term of this patent is extended or adjusted under 35 U.S.C. 154(b) by 312 days.

(21) Appl. No.: 15/836,609

(22) Filed: Dec. 8, 2017

(65) Prior Publication Data

US 2018/0162563 A1 Jun. 14, 2018

(30) Foreign Application Priority Data

Dec. 9, 2016 (DE) ..... 10 2016 123 926
Aug. 23, 2017 (DE) ..... 10 2017 119 297

(51) Int. Cl.

| | |
|---|---|
| ***B65B 1/12*** | (2006.01) |
| ***B65B 35/24*** | (2006.01) |
| ***B65B 39/00*** | (2006.01) |
| ***B65B 57/14*** | (2006.01) |
| ***B65B 27/12*** | (2006.01) |
| ***B65B 39/10*** | (2006.01) |
| ***B65B 37/00*** | (2006.01) |
| *E02B 3/12* | (2006.01) |

(52) U.S. Cl.

CPC ..... *B65B 1/12* (2013.01); *B65B 27/125* (2013.01); *B65B 35/24* (2013.01); *B65B 37/005* (2013.01); *B65B 39/007* (2013.01); *B65B 39/10* (2013.01); *B65B 57/145* (2013.01); *E02B 3/12* (2013.01); *E02B 3/127* (2013.01)

(58) Field of Classification Search

CPC B65B 1/12; B65B 1/125; B65B 35/24; B65B 37/005; B65B 39/007; B65B 39/10; B65B 57/145; E02B 3/12; E02B 3/127

See application file for complete search history.

(56) References Cited

U.S. PATENT DOCUMENTS 1,506,036 A * 8/1924 Willmarth ..... B30B 11/24 44/630
2,003,417 A * 6/1935 Arno ..... B65B 1/12 414/21

(Continued)

OTHER PUBLICATIONS

German Office Action, dated Apr. 25, 2018, for German Application No. 10 2017 119 297.2, 8 pages.

*Primary Examiner* — Nathaniel C Chukwurah
*Assistant Examiner* — Lucas E. A. Palmer
(74) *Attorney, Agent, or Firm* — Seed IP Law Group LLP

(57) ABSTRACT

A device and a method for producing fascines in particular straw-fiber fascines, coconut-fiber fascines, wood-fiber fascines, and hemp-fiber fascines are provided. The device comprises a plurality of conveyor screws for conveying fibrous material such as straw fibers, coconut fibers, wood fibers, or hemp fibers, in a tubular element for filling the fibrous material into a tubular net. Moreover, the device comprises a distributor box. The distributor box has an interior space having an infeed opening for infeeding the fibrous material, and one or a plurality of base-side openings. The base-side openings herein serve for in-feeding fibrous material from the distributor box to the conveyor screws.

17 Claims, 5 Drawing Sheets

(56) References Cited

U.S. PATENT DOCUMENTS

| | | | | |
|---|---|---|---|---|
| 3,593,484 | A | 7/1971 | Dussich | |
| 3,658,212 | A * | 4/1972 | Ullberg | B65B 37/10 222/240 |
| 3,722,755 | A * | 3/1973 | Nakashima | B65B 1/18 141/67 |
| 5,519,985 | A * | 5/1996 | Dyck | A01F 25/14 53/527 |
| 5,740,950 | A * | 4/1998 | Kanzler | B65B 1/08 141/313 |
| 5,894,871 | A * | 4/1999 | Greer | B65B 1/12 141/102 |
| 6,533,143 | B1 * | 3/2003 | Yaguchi | B65B 1/12 222/135 |
| 6,658,825 | B1 * | 12/2003 | Bliek | B65B 1/06 53/512 |
| 9,586,770 | B2 * | 3/2017 | Koenig | B65G 65/40 |
| 2006/0151057 | A1 * | 7/2006 | Sweningson | B65B 1/12 141/114 |
| 2006/0180238 | A1 * | 8/2006 | Koelker | A01F 25/183 141/114 |
| 2007/0095747 | A1 | 5/2007 | Theisen et al. | |
| 2007/0193231 | A1 * | 8/2007 | Deitering | A01F 25/14 53/576 |
| 2015/0298841 | A1 * | 10/2015 | Ensor | B65B 43/465 53/475 |

* cited by examiner

DEVICE AND METHOD FOR PRODUCING FASCINES

BACKGROUND

Technical Field

This disclosure relates to the field of fascines, in particular to fibrous fascines such as straw or coconut fascines which are used in the defense of erosion phenomena, or breaches of escarpments, respectively.

Description of the Related Art

The term fascines is to be understood to mean cylindrical construction elements of typically a plurality of meters in length. Said fascines are produced from a fibrous material, for example, in that the fibrous material, specifically straw, coconut, compost, xylite fibers, for example, or fiber mixtures, is compressed or pressed and is held by a tubular net. The tubular net is preferably composed of a tubular plastic net, for example of a tear-resistant PE net.

Fascines can be employed in a variety of manners and serve for fastening or reinforcing escarpments, for example. To this end, the fascines at the site of application are fastened by stakes, for example. The fascines can furthermore also be used in hydraulic engineering for fastening banks or channel beds. Apart from the field of application on escarpments and water bodies in the context of erosion protection, the fascines are mainly employed for retaining sediments. On account of the sediments, only water is passed through in the case of precipitation such that no sediments make their way into water streams or wastewater ducts.

Overall, the field of application of fascines is very wide, and the latter therefore are also available for the respective applications in arbitrary sizes, for example with diameters of a few centimeters up to approximately fifty centimeters, and lengths of one to several meters.

In order for the fascines, specifically the fibrous fascines such as, for example, straw-fiber fascines, coconut-fiber fascines, wood-wool fascines, wood-fiber fascines, or hemp-fiber fascines to be produced, the respective fibrous material from straw, coconut, wood wool, wood, or hemp, is introduced into a tubular element at a first end of the tubular element. By further exerting a force in the introduction of the fibrous material, the latter is guided through the tubular element up to an opposite end of the tubular element. The fibrous material then exits the tubular element at the opposite end of the tubular element and herein is caught and held by a tubular net.

The tubular net can also be referred to as a mesh tube and is preferably composed of a plastic material such as polypropylene, of a textile material or natural fibers such as jute or coconut fibers. Depending on the desired use and on the fibrous material used for the filling, the tubular nets have an adapted pore size or mesh width. In order for the fibrous material to be caught and held, the tubular net in an endless embodiment is disposed so as to be gathered across the end of the tubular element from which the fibrous material exits. Accordingly, the tubular net unfolds from the end of the tubular element simultaneously with the introduction of the fibrous material such that the tubular net holds the fibrous material thus compressed or pressed. The mentioned fascines are produced with a desired length by targeted switching off of the indexing of the fibrous material through the tubular element after the tubular net has been filled with a specific length and after the tubular net has been closed and severed.

Various devices for the automated or semi-automated production of fascines are indeed already known. However, said devices have the disadvantage that a large deployment of personnel is required despite the use of the devices. Moreover, the demand for fascines is increasing by virtue of the ever increasing number of interventions in the landscape, wherein the known devices in terms of their production rates thereof are inefficient in order for this demand to be met.

BRIEF SUMMARY

Embodiments of the present invention provide a device and a method for producing fascines in which as low an effort as possible in terms of personnel is required and in which a particularly large quantity of fascines can simultaneously be produced in an efficient manner.

To this end, embodiments of the invention relate to a device and to a method for producing fascines. In particular, the device serves for producing fibrous fascines such as straw-fiber fascines, coconut-fiber fascines, wood wool fascines, wood-fiber fascines, hemp-fiber fascines, compost-fiber fascines, xylite-fiber fascines, and fascines from fiber mixtures. The fibrous fascines discussed here are also referred to in the industry as "wattles" and, in particular in the case of straw-fiber fascines, "straw wattles." The terms fibrous fascines and fascines hereunder are used synonymously.

The fascines discussed here correspond in each case to a cylindrical or a roller-type element. This element is formed by a tubular net in which a fibrous material such as, for example, straw fibers, coconut fibers, wood fibers, hemp fibers, compost fibers, xylite fibers, or fiber mixtures, are held in a pressed form. Fascines of this type have a length of up to several meters and a diameter of a few up to, for example, 50 centimeters.

For the production, embodiments of the invention comprise a plurality of tubular elements and a plurality of conveyor screws, wherein each tubular element is in each case assigned one of the conveyor screws. The conveyor screws serve for conveying the fibrous material in the tubular element for introducing the fibrous material into tubular nets. Tubular elements here preferably comprise elements having a round cross section, wherein embodiments of the invention are not limited to tubular elements of this type and also comprises tubular elements having a square cross section, for example.

The device thus has not only one but a plurality of conveyor screws which in each case preferably protrude into a first region of a first end of the tubular element, in order for the fibrous material to be introduced into the tubular element at the first end of the tubular element and thus to be conveyed or pressed through the tubular element such that the fibrous material can exit at an opposite end of the tubular element. The fibrous material is thus received by a tubular net that is pulled over the opposite end of the tubular element. Each conveyor screw in each case thus serves for conveying and introducing fibrous material into a tubular net that is assigned to the respective conveyor screw.

Embodiments of the invention furthermore comprise a distributor box which has an interior space having at least one infeed opening for infeeding the fibrous material. The interior space is formed by, for example, a plurality, preferably four, external walls, preferably one front wall and one rear wall which are interconnected by two side walls. The infeed opening is preferably disposed in a region which in the intended use of the device lies in the upper region of the distributor box.

The distributor box moreover comprises at least one base-side opening, wherein the or each of the base-side openings in the intended use is in each case disposed above the conveyor screws, or one of the conveyor screws, in the region of the conveyor screws. These base-side openings thus serve in each case for infeeding fibrous material that has been received by the distributor box to the conveyor screws.

The fibrous material is distributed across all base-side openings by way of the common distributor box. In the case of identical conveying speeds of the conveyor screws, substantially the same quantity of the fibrous material can thus be conveyed onward in each conveyor screw. It is guaranteed on account thereof that in the case of the conveyor screws being operated at substantially identical conveying speeds a plurality of fascines are produced simultaneously and at substantially identical speeds, such that said fascines that are simultaneously produced can be further processed in parallel. Overall, an improved automated further processing of the fascines is possible on account of the further processing in parallel.

A particularly favorable possibility for producing a plurality of fascines at identical speeds without a complex supervision of the quantity of fibrous material that has been infed to a plurality of conveyor screws that are disposed in parallel having to be carried out in each case individually for each conveyor screw has thus been found at the same time. Infeeding of fibrous material by way of a single conveyor belt is thus possible.

According to a first embodiment, the distributor box has a predefined minimum height. The minimum height preferably depends on the number of conveyor screws. For example, the distributor box has a height of at least 3 or 3.5 meters when the number of conveyor screws corresponds to 4 conveyor screws, or has a height of at least 4 or 4.5 meters when the number of conveyor screws corresponds to 5 conveyor screws.

It is thus guaranteed that sufficient fibrous material can be filled into the box in order for all base-side openings to be reliably supplied with fibrous material even when the fibrous material by virtue of the friction between the fibers piles up in the region of the infeed opening.

According to a further embodiment, the device has between 2 and 10 conveyor screws, preferably 4 or 6 conveyor screws. An even number of conveyor screws and thus of simultaneously produced fascines facilitates the handling of the fascines produced since the operating personnel can be employed in an optimal manner.

According to a further embodiment, the distributor box has a plurality of distributor cams which are preferably fastened to at least one of the external walls of the distributor box. The distributor cams are disposed in such a manner so as to distribute fibrous material that is infed into the infeed opening in the direction of base-side openings that lie laterally more remote from the infeed opening. Alternatively or additionally, the distributor box has one or a plurality of conveyor belts which are preferably mounted on the front wall and on the rear wall in the distributor box, the conveying direction of said conveyor belts running parallel with the profile of the front and the rear wall. Furthermore, the one or the plurality of conveyor belts are also disposed in such a manner so as to distribute fibrous material that is infed into the infeed opening in the direction of base-side openings that lie laterally more remote from the infeed opening.

It is guaranteed by the distributor cams that the distributor box can have a comparatively minor height, since any piling up of the fibrous material on account of friction of the fibrous material is reduced on account of the reduction in friction in the region of the distributor cams.

For example, the fibrous material by way of the infeed opening is infed to the distributor box at a central point, for example in the center on the upper side of the distributor box. Said fibrous material drops into the distributor box and on account of gravity and friction is distributed towards the sides, wherein piling-up or accumulating takes place in the region of the infeed opening, however.

Therefore, if the distributor box is thus not filled high enough with the fibrous material, base-side opening or regions of the base-side opening can be without fibrous material, said openings or regions specifically being disposed so as to be laterally more remote from the infeed opening. On account thereof, conveyor screws below these base-side openings or regions of the base-side openings can run empty such that said conveyor screws produce fascines more slowly than the other conveyor screws.

If distributor cams are now disposed, the fibrous material can slide, or be directed, along the distributor cams also towards base-side openings that are laterally more remote from the infeed opening. On account thereof, the piling-up of fibrous material in the region of the infeed opening is reduced such that the distributor box has to be filled to a comparatively minor height. A distributor box having a comparatively minor height is possible on account thereof, such that a minor installation space is required for the operation of the device.

Alternatively or additionally, the conveyor belt or the conveyor belts serves for reducing the piling-up of the fibrous material in the region of the infeed opening and for infeeding fibrous material to the base-side openings and thus to the conveyor screws in a uniform or controlled manner. Thanks to the conveyor belts, the conveying direction and/or the conveying speed thereof according to further embodiments being controllable, conveyor screws of different sizes can also be provided for conveying fibrous material into tubular elements having diameters of different sizes. The conveyor belt or the conveyor belts here serves for infeeding targeted quantities of fibrous material to the individual conveyor screws. The conveyor belts are preferably disposed in the upper region of the distributor box.

According to a further embodiment, in addition to or instead of the distributor cams or of the at least one conveyor belt, at least one screw distributor which distributes the fibrous material from the infeed opening in the direction of the base-side openings that lie laterally beside the infeed opening is provided in the distributor box. The screw distributor, or the screw distributors, are preferably disposed in the upper part of the distributor box.

According to a further embodiment, the distributor box has at least one filling level sensor, for example a light barrier or a photocell. The filling level sensor preferably serves for determining the attainment of a filling height of the distributor box. Alternatively or additionally, the filling level sensor serves for determining the filling height.

It is guaranteed on account thereof that a minimum filling height is attained at all times so as to keep the base-side openings covered with fibrous material despite the piling-up or the accumulation mentioned. To this end, the filling level sensor is in particular electrically connected to, for example, a drive of a conveying installation such as, for example, a conveyor belt, which infeeds the fibrous material to the infeed opening. The conveying installation by way of the filling level sensor is, for example, capable of being started or stopped, or regulatable in the speed thereof.

According to a further embodiment, each of the conveyor screws is disposed in each case in a narrow region of a collection container, wherein the collection container has at least in part a funnel-shaped profile and thus, apart from the narrow region, has a wider region. The wider region of the collection container in this instance is disposed in the region of or on one of the base-side openings of the distributor box. The collection container thus preferably corresponds to a trough.

The fibrous material, on account thereof, in the intended use of the device is reliably infed from the distributor box to in each case each of the conveyor screws.

According to a further embodiment, at least one cellular wheel, or preferably two cellular wheels that rotate in opposite direction and are mutually spaced apart is/are disposed in the region of each of the collection containers. Said cellular wheels serve for metering and/or conveying the quantity of fibrous material that is infed to the respective conveyor screw by way of the base-side opening. On the one hand, clogging of the conveyor screws is counteracted, and on the other hand the uniform and simultaneous production of a plurality of fascines can be better controlled. A roll or a roller having elevations distributed on the rotating shell face is referred to here as a cellular wheel.

According to a further embodiment, the conveyor screws are fastened in the collection container in such a manner that said conveyor screws are exchangeable. In the case of a conveyor screw being damaged, the latter can thus be removed from the collection container in a simple manner by extraction once a mounting flange has been released, and be replaced by a spare conveyor screw. At the same time, a complete collection container or at least the lower region of the collection container in which the conveyor screw is disposed is also constructed so as to be easily exchangeable by releasing a few connection elements.

According to a further embodiment, each collection container has a lower region in which the conveyor screw is disposed. Moreover, each collection container has an upper region in which two cellular wheels are disposed. The cellular wheels in the upper region are specified for rotating in opposite directions and for thus forming a conveying region. The conveying region thus corresponds to the intermediate space between the cellular wheels. The cellular wheels are externally delimited by the wall of the collection container. Fibrous material is conveyed in the conveying region by the rotation of the cellular wheels in a direction from the upper region to the lower region. The spacing of the cellular wheels is preferably dependent on the material to be conveyed.

Moreover, each of the collection containers comprises a central region in which an outlet region of the conveying region that is formed by the cellular wheels is defined. According to this embodiment, a distributor roller for loosening the fibrous material that is conveyed by way of the cellular wheels is disposed in the outlet region. The distributor roller is preferably a drum. Thanks to the distributor roller which is disposed in the outlet region, downstream of the conveying region of the cellular wheels, compressed fibrous material, said fibrous material on account of the conveyance by way of the cellular wheels that rotate in opposite directions potentially being compressed, is loosened again and thus drops into the conveyor screw in a loose form. Clogging of the conveyor screw is thus counteracted. The distributor roller thus combs out fibrous material that has been compressed by the cellular wheels.

According to a further embodiment, the distributor box has a plurality of base-side openings which in each case guide fibrous material to one of the collection containers. The openings are formed by way of guide walls which are simple sheet-metal panels, for example. The guide walls by way of the sides thereof that delimit a plane are preferably connected to the front wall and to the rear wall of the distributor box. Planes which are formed by the guide walls run at least partially parallel with the rotation axes of the cellular wheels and, for forming the opening, terminate in a substantially centrical manner above a cellular wheel. An opening which is delimited or formed by the front wall and the rear wall of the distributor box and by, for example, two guide walls, is thus preferably defined above each collection container.

Fibrous material is thus guided by the guide walls in the direction of the cellular wheels, wherein it is guaranteed by the termination of the guide walls in a centrical manner above the cellular wheels that the fibrous material at all times is imparted a conveying direction having a downward directional component in the direction toward the conveyor screw and fibrous material can thus not accumulate above the cellular wheel and thus lead to clogging.

According to a particularly preferred embodiment, each opening has two parallel guide walls that at least partially run in a vertical direction and which in each case terminate in a centrical manner above one of two cellular wheels of one collection container. The cellular wheels rotate in opposite directions such that fibrous material which by the guide walls is infed to the cellular wheels in the conveying region of the latter, that is to say in the central region between the cellular wheels, is moved onward, that is to say conveyed, in a direction from the distributor box in the direction of the conveyor screws. In a rotation of the cellular wheels by way of which a force is exerted on the fibrous material, it is prevented on account of the guide walls that terminate in a substantially centrical manner above the cellular wheels that a force which has a horizontal directional component or has a component counter to the envisaged conveying direction is exerted on the fibrous material. Clogging in the entry region of the conveying region of the cellular wheels is thus substantially counteracted.

According to a further embodiment, neighboring guide walls, or guide walls of neighboring openings, converge in an upper region of the distributor box. The neighboring guide walls meet in a connection region which preferably corresponds to a rounded feature, to an acute angle, or to a right angle. Accordingly, each of the guide walls thus runs from a lower end which terminates in a substantially centrical manner above the cellular wheel, up to an upper end. Two upper ends of guide walls of neighboring openings, that is to say of neighboring guide walls, thus form a connection region in which the guide walls are connected, for example also preferably by welding or brazing/soldering. This connection region is rounded or has an acute or right angle. It is prevented on account thereof that fibrous material which is introduced into the distributor box is deposited on planar faces. Planar faces are avoided on account of the arrangement of the guide walls in the distributor box.

According to a further embodiment, in each case one movable element, for example one of the conveyor belts or a distributor roller, is disposed in the region of the connection regions of the guide walls. The movable elements, by setting in motion the movable element, serve for removing also deposited fibrous material which despite the rounded feature or the angle in the connection region is deposited there. A deposition of the fibrous material and a piling-up of the latter over the course of time, which can lead to clogging, is thus prevented.

According to a further embodiment, each conveyor screw is assigned a sensor, in particular a photocell or a light barrier. The sensor is disposed in the distributor box above the respective conveyor screw. Moreover, one or a plurality of conveyor belts which are in each case operable so as to be stopped, advanced, or reversed, depending on the light barriers, are disposed in the distributor box.

On account thereof, the conveyor belts can be employed for infeeding material to those conveyor screws in a targeted manner to which a decreasing quantity or reserve of fibrous material is available, as signaled by the light barriers. In particular in the case in which fascines of different sizes or fascines of different densities are produced, or in which fascines are produced at dissimilar speeds by means of the plurality of conveyor screws, it is thus guaranteed by the conveyor belts in conjunction with the light barriers that each conveyor screw is made available sufficient fibrous material such that running empty is avoided.

According to a particularly advantageous embodiment, the device comprises four conveyor screws and two conveyor belts. A first of the two conveyor belts is actuatable by a controller in such a manner that the first conveyor belt remains stopped when two predetermined sensors are triggered. Triggered indicates interrupted light barriers, for example. The first conveyor belt is advanced when one of the two predetermined sensors is triggered, and is reversed when the other of the two predetermined sensors is triggered. Moreover, a second of the two conveyor belts is actuatable by a controller in such a manner that the second conveyor belt remains stopped when the two other predetermined sensors are triggered. The second conveyor belt is advanced when one of the two other predetermined sensors is triggered, and is reversed when the other of the two other predetermined sensors is triggered.

On account of this construction, four conveyor screws can be infed with material in a targeted manner.

According to a further embodiment, the device has two conveyor belts which are disposed beside one another and in each case in terms of height decline from the center of the distributor box to the lateral external walls of the distributor box. The conveyor belts are thus mounted so as to be higher in the center of the distributor box than in the lateral regions. A gap is disposed between the conveyor belts, and a distributor roller is preferably disposed in the region of the gap. A distribution of the fibrous material to four conveyor screws can be advantageously implemented on account of this construction.

According to a further embodiment, the device comprises an installation for closing the tubular net and for severing the tubular net. The installation is preferably activated when the fascine produced reaches a predefined length and is thus completed. The installation in this instance exerts a short abrupt indexing motion on the completed fascine such that the fascine, for example by a conveyor belt, is moved away from the exit of the tubular element. On account thereof, a region of unwound tubular net which is not filled with fibrous material is created. Moreover, the installation in this instance is specified for closing the tubular net at two locations. This is preferably performed by wrapping with a tape. The tubular net is then severed by way of the installation between the two closure locations of the tubular net.

The operation of the device entirely without personnel is thus possible in a fully automated manner.

According to a further embodiment, the conveyor screw in the intended use of the device is disposed so as to be substantially horizontal, wherein the fibrous material in this instance drops into the lower region of the collection container, that is to say into the trough, for example, and thus into the conveyor screw solely on account of gravity, preferably upon metering by the cellular wheels. The conveyor screws in this instance are disposed so as to be mutually parallel such that the fascines exit the device horizontally on one side of the device. Further processing of a plurality of simultaneously produced fascines is possible by a simple removal of the fascines on one side of the device.

According to a further embodiment, the device comprises a winding device which is specified for simultaneously winding a plurality of fascines produced.

A winding device of this type in the case of the devices to date for producing fascines has not been implementable as an integral part since the fascines by virtue of different production speeds have exited the device at different speeds, a simultaneous winding of a plurality of fascines thus not having been possible.

According to one particular embodiment, a predefined minimum spacing is provided between the winding device and the end of the tubular element where the fascines exit. It is enabled on account thereof that a buffer region is provided in the case of the production of a plurality of fascines which are produced at slightly different speeds, fascines that have been produced at a higher speed being able to be automatically deposited in said buffer region in a slightly arcuate manner, while fascines that are produced at a slower speed are already being rolled up on a roll of the winding device.

According to a further embodiment the device comprises a controller which is specified for starting and stopping the advance of the conveyor screws. To this end, the controller is connected to a switch which can be manually activated, for example. According to the embodiment, the controller when starting the advance of the conveyor screw, that is to say in the rotation direction of the conveyor screw at which a fascine is produced, is specified for switching the conveyor screw to reverse for a predefined temporal period or for a predefined number of revolutions, in order for the advance to be automatically commenced thereafter.

It is guaranteed on account thereof that fibrous material which upon the advance being switched-off is located within a conveyor screw when stationary, by virtue of the pressure of the compressed fibrous material that is located in the distributor box, does not lead to clogging of the conveyor screw in the renewed start-up of the conveyor screw, since loosening is performed on account of the brief reversing.

The controller preferably also serves for controlling the conveyor belts in the distributor box, depending on the light barriers above each of the conveyor screws.

Other embodiments of the invention furthermore relate to a method for producing fascines by way of a device according to one of the aforementioned embodiments.

BRIEF DESCRIPTION OF THE SEVERAL VIEWS OF THE DRAWINGS

Further embodiments are derived by means of the exemplary embodiments that are explained in more detail in the figures in which.

DETAILED DESCRIPTION

Figure 1:
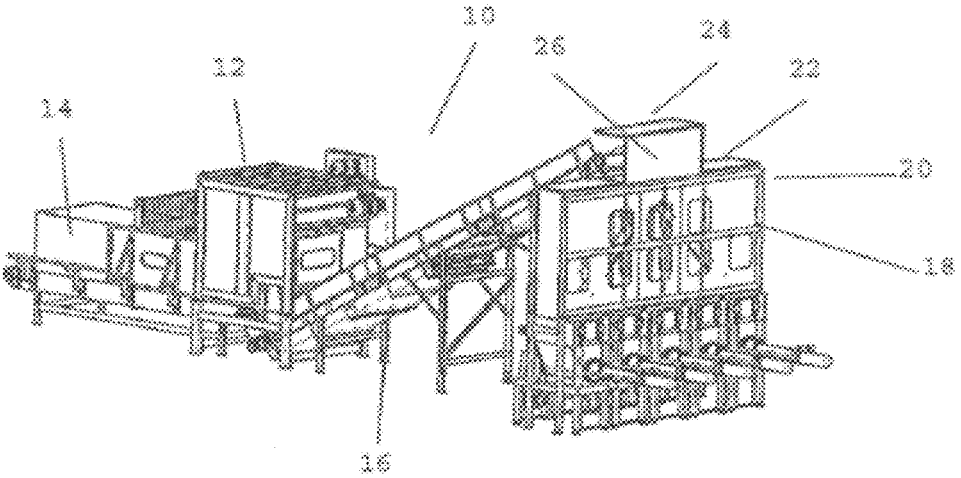
FIG. 1 shows a perspective view of an exemplary embodiment of a device for producing fascines.

FIG. 1 shows a first exemplary embodiment of the device 10 for producing fascines 52. The device 10 in this exemplary embodiment comprises a bale opener 12 in order for straw bales 14 to be opened and loosened, said straw bales 14 having previously been pressed by a straw press for improved transportation in a standard bale size.

The device 10 according to this exemplary embodiment thus serves for producing fascines from straw or straw fibers, that is to say straw fascines or straw-fiber fascines which are also referred to as "straw wattles." In the case of a fibrous material being delivered in an already loosened state, an alternative embodiment having the features mentioned hereunder, also without the bail opener 12, is possible.

The loosened fibrous material is infed to a distributor box 18 by way of a conveying installation, for example a conveyor belt 16.

The distributor box 18 on the upper side 20 thereof has an infeed opening 22. The fibrous material, presently straw, is thus infed to the distributor box 18 by way of the infeed opening 22 with the aid of the conveyor belt 16. According to this exemplary embodiment, an optional guard 26 is provided in the region of the infeed opening in order to prevent that the fibrous material that is conveyed by the conveyor belt 16 in the case of a rapid conveying speed of the conveyor belt 16 is catapulted beyond the distributor box 18. The fibrous material drops into the distributor box 18 on account of gravity.

Figure 2:
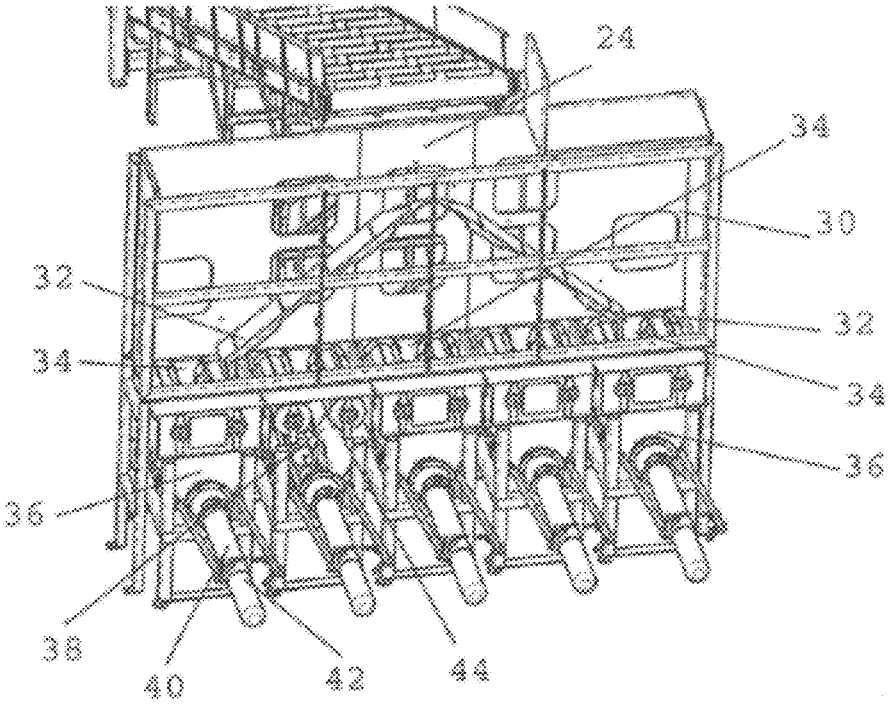
FIG. 2 shows a further view of the device having a partially open front wall of the distributor box.

Parts of the front wall and part of an upper side of the distributor box 18 of the device 10 in FIG. 2 have now been partially removed for a better view and for explaining the function mode. The observer is thus looking into the interior space 30 of the distributor box 18. Distributor cams 32 which enable a partial distribution of the fibrous material laterally away from the central region 24 to which the fibrous material is infed by way of the conveyor belt 16 can be seen.

The interior space 30 of the distributor box 18 is thus filled with a specific quantity of fibrous material by way of the conveyor belt 16. Attention is preferably paid to a specific minimum filling height being adhered to at all times herein by regulating or controlling the conveying speed of the conveyor belt 16 depending on a filling height sensor, for example a light barrier or a photocell.

Base-side openings 34 are illustrated in the lower region of the distributor box 18. According to this exemplary embodiment which serves for simultaneously producing five fascines 52, five base-side openings 34 are illustrated in a corresponding manner. The openings are in each case connected to a collection container 36 in order for the fibrous material to be infed from the distributor box 18 by way of the collection container 36 to a conveyor screw 38 that is disposed in the lower region of the collection container 36.

The conveyor screws 38 in each case press the fibrous material into a tubular element 40, wherein the compressed fibrous material at the exit 42 of each of the tubular elements 40 is pressed into a tubular net. To this end, the tubular net is pulled over an end of the tubular element at the exit 42 of the respective tubular element 40. Thereabove, in each case two cellular wheels 44 for metering the fibrous material are disposed in the region of the collection container 36. These cellular wheels 44, as are also the screws 38, are preferably driven by electric motors.

Figure 3:
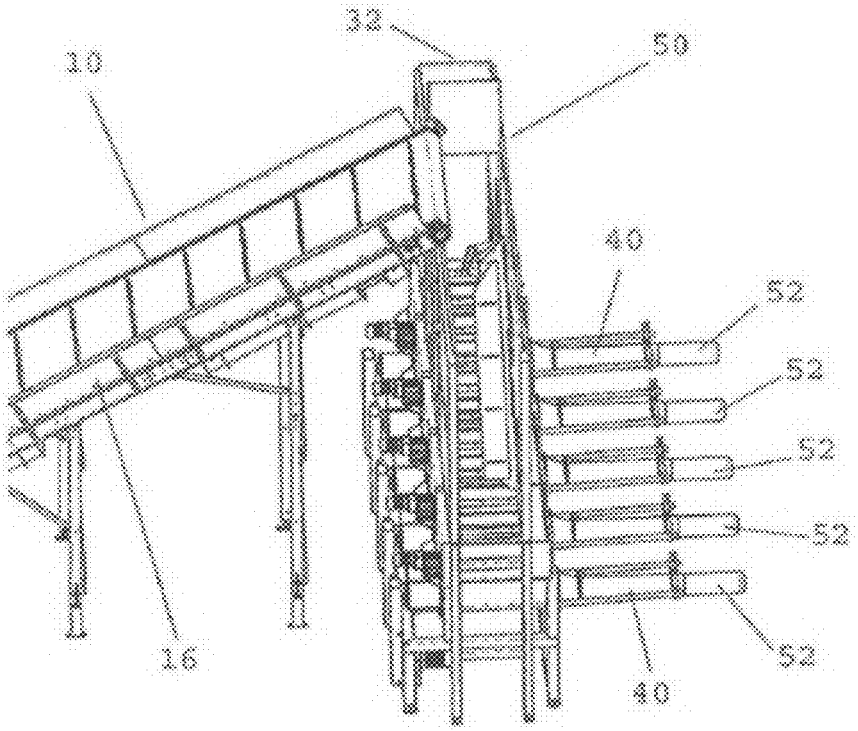
FIG. 3 shows a side view having an open external wall.

FIG. 3 again shows the distributor box 18 of the device 10 from a lateral view point, wherein an external wall is removed. It can be seen on account thereof that the distributor cams 32 are fastened to the front wall 50 and do not extend across the entire depth of the interior space 30. Only part of the fibrous material thus drops by way of the distributor cams 32 from the central region 24 on which the infeed opening 22 is disposed in the direction of the base-side openings 34 which lie laterally to the central region 24. A further part drops past the distributor cams 32, in a substantially vertical manner, to the base-side openings 34 which are located directly below the central region 24.

Figure 4:
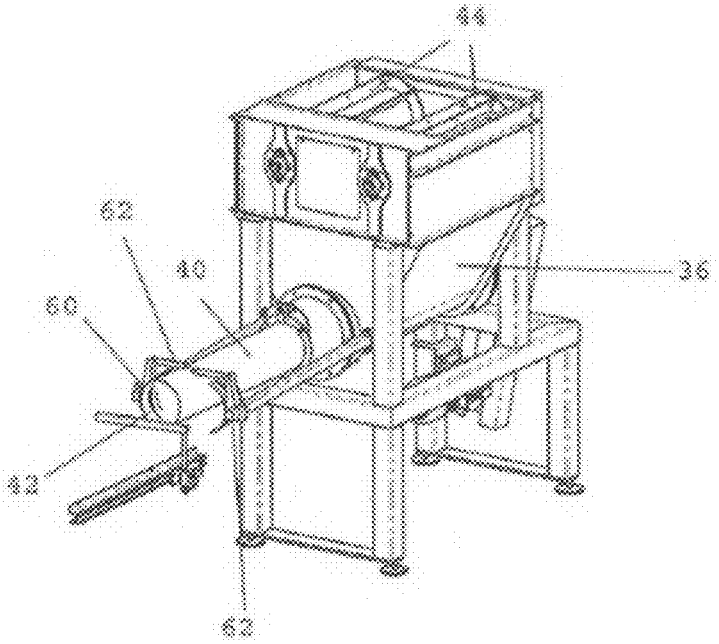
FIG. 4 shows a conveyor screw having a collection container disposed thereon.

FIG. 4 shows an enlargement of a collection container 36 that has been released from the device 10, having a conveyor screw 38 disposed therein for producing a fascine 52. The tubular element 40 which serves for filling the fibrous material into a tubular net (not illustrated here) can also be seen here. Tensioners 62 by way of which the tubular net that is pulled over onto the tubular element 40 is held are at that end 60 of the tubular element 40 on which the exit 42 is disposed. The tubular net by way of the tensioner 62 is held on the tubular element 40 at a predefined tension, counter to the force of the compressed fibrous material that exits from the exit 42. The tensioners 62 are adjustable such that the mesh tube or the tubular net is held on the tubular element 40 by way of a variable force so as to regulate the density of the fibrous material that is pressed into the net.

The cellular wheels 44 for metering the fibrous material are illustrated in the upper region.

Figure 5:
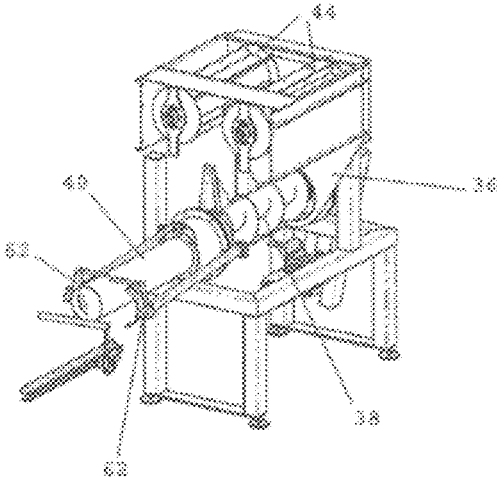
FIG. 5 shows a conveyor screw having a partially open wall of the collection container.

FIG. 5 shows a view of the collection container 36 with the conveyor screw 38, having partially open walls of the collection container 36 in order to be able to have a better view into the interior space 30 of the collection container 36. It can be seen here that the fibrous material on account of gravity drops from above onto the conveyor screw 38 and, on account of the rotation direction of the conveyor screw 38 when advancing, the fibrous material is pressed into the tubular element 40, in order for the latter to be caught in the tubular net at the exit and thus to be formed into a fascine 52.

Figure 6:
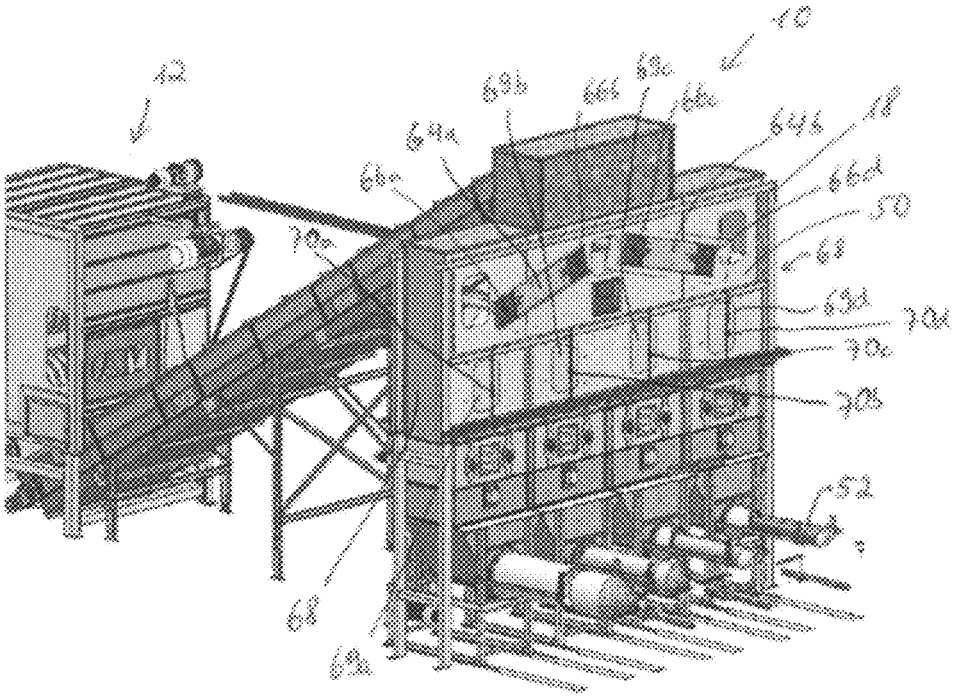
FIG. 6 shows a perspective view of a further exemplary embodiment of a device for producing fascines.

FIG. 6 shows a further exemplary embodiment of the device 10. The bale opener 12 is again illustrated. As opposed to the exemplary embodiment in FIG. 1, the device 10 serves for simultaneously producing four instead of five fascines 52 having different diameters. To this end, a distributor box 18 is again provided, said distributor box 18 according to this exemplary embodiment however having two conveyor belts 64*a*, 64*b*. Only the axles 66*a*-66*d* of the conveyor belts 64*a*, 64*b* can be seen since the front wall 50 of the distributor box 18 is closed and the axles 66*a*-66*d* are mounted herein. The conveyor belts 64*a*, 64*b* run from a central region 67 of the distributor box 18 in the direction of the side walls 68 of the distributor box 18, wherein the conveyor belts 64*a*, 64*b* decline in height towards the sidewalls 68.

The distributor box 18 in the front wall 50 thereof moreover has four glass windows 69*a*-69*d*. In each case one light barrier 70*a*-70*d* is disposed in the region of the glass windows 69*a*-69*d*. The light barriers 70*a*-70*d* are thus disposed in each case above one of the conveyor screws 38. The conveyor belts 64*a*, 64*b* are controlled so as to depend on the light barriers 70*a*-70*d*. For example, the left conveyor belt 64*a* does not convey any fibrous material when the light barriers 70*a*, 70*b* are interrupted, that is to say when sufficient fibrous material is available above the two conveyor screws that are illustrated on the left. If only the left light barrier 70*a* is still interrupted, the conveyor belt 64*a* in a reverse motion conveys the fibrous material to the right in this view, such that said fibrous material is substantially infed to the screw conveyor which lies beside the left external conveyor screw. By contrast, if only the light barrier 70*b* is still interrupted, but not the light barrier 70*a*, this means that the conveyor screw at the extreme left requires more fibrous material such that the conveyor belt 64*a* advances, that is conveys fibrous material to the left in this view. An analogous actuation depending on the light barriers 70*c*, 70*d* is imparted to the conveyor belt 64*b*.

Further peculiarities and points of differentiation of the exemplary embodiment of the device 10 illustrated here in relation to the device illustrated in FIG. 1 will be described with reference to the following figure.

Figure 7:
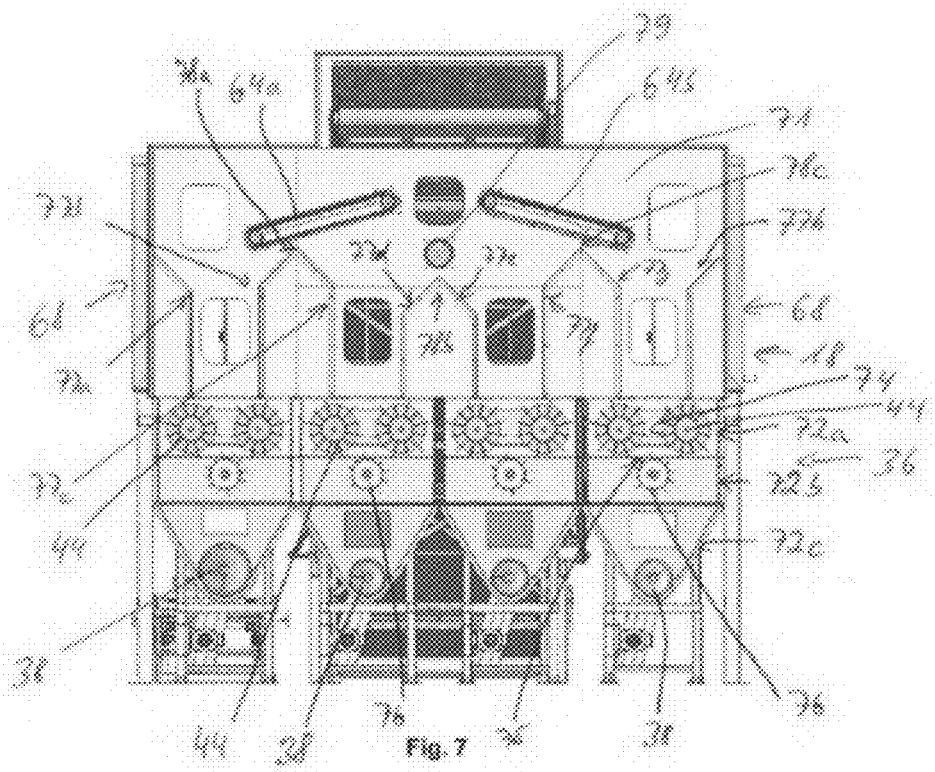
FIG. 7 shows a further view of the device having a partially open front wall of the distributor box.

To this end, the front wall 50 is not illustrated in FIG. 7, such that the view onto the rear wall 71 of the distributor box 18 is unobstructed. The two conveyor belts 64*a*, 64*b* can now be seen in the distributor box 18. Moreover, it is illustrated that the collection containers 36 in relation to the exemplary embodiment in FIGS. 1 to 5 have an upper region 72*a*, a central region 72*b*, and a lower region 72*c*. The conveyor screws 38 are in each case disposed in the lower region 72*c*. The cellular wheels 44 are disposed in the upper region 72*a* such that in each case one conveying region 74 is formed between the cellular wheels 44 of one collection container 36. A distributor roller 76 which is a drum, for example, is disposed in the outlet region 75 of the conveying region 74. Fibrous material that is compressed in the conveying region 74 is again loosened by the distributor roller 76.

Guide walls 77*a*-77*h* are furthermore illustrated. The guide walls 77*a*-77*h* terminate in each case in a centrical manner above one of the cellular wheels 44. Neighboring guide walls 77*a*-77*h*, presently specifically the guide walls 77*b* and 77*c*, 77*d* and 77*e*, 77*f* and 77*g*, converge in an oblique manner in the upper region 72*a* and are in each case interconnected in a connection region 78*a*-78*c*. The conveyor belts 64*a*, 64*b* run in the connection regions 78*a* and 78*c*, wherein a further distributor roller 79 is disposed in the connection region 78*b*. The distributor roller 79, like the conveyor belts 64*a*, 64*b*, serves to prevent fibrous material depositions arising in the distributor box 18, on account of which clogging can occur.

The guide walls 77*a*-77*h* infeed the fibrous material to the cellular wheels 44 and thus to the conveyor screws 38. On account of the guide walls 77*a*-77*h* terminating in a centrical manner or at least in a substantially centrical manner above the cellular wheels 44, substantially no horizontal forces are exerted on the fibrous material, and forces which press the fibrous material in the direction back into the distributor box 18 are also not exerted on the fibrous material. A conveyance of the fibrous material counter to the actual conveying direction thereof and counter to gravity is thus avoided, such that clogging in the region of the cellular wheels 44 is prevented.

Figure 8:
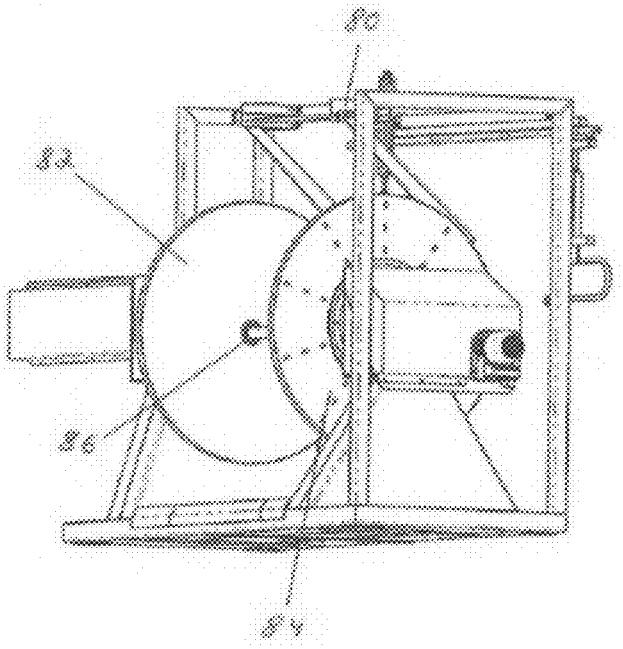
FIG. 8 shows a winding device.

FIG. 8 shows a winding device 80 as a component part of the device 10 according to one embodiment, so as to directly wind a plurality of produced fascines 52 to form a roll, so as to be able to better transport a plurality of fascines 52. The winding device 80 has two flange discs 82, 84 which serve for delimiting the fascines 52 when the latter are rolled about a central bar 86. To this end, the central bar 86 is disposed between the two discs 82, 84 and is specified for fastening the fascines 52 by way of one end to said bar 86. The fascines 52 are then wound by the rotation of the central bar 86.

Once a roll having a plurality of fascines 52 that are disposed beside one another has been produced, said roll for improved transportation is compressed by the discs 82, 84 which are converged. The roll can now finally be wrapped with a film in order for said roll to be able to be transported in a clean manner, without the fibrous material falling off, and to keep said roll in its shape.

Figure 9:
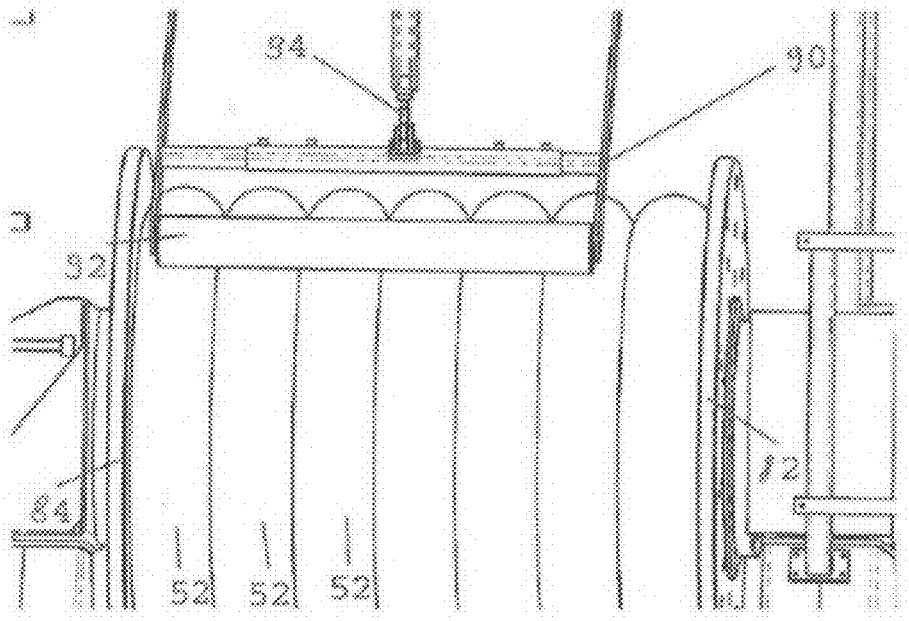
FIG. 9 shows a further view of the winding device.

FIG. 9 shows a side view of the winding device 80. A pressure roller 92 which is held by a mounting 90 to which a cylinder 94 is connected is illustrated here, said pressure roller 92 in the winding of the roll of fascines 52 pressing from the outside against the fascines in order to guarantee a compact winding.

Aspects and features of the various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet, including but not limited to German Patent Application Nos. 102017119297.2 filed Aug. 23, 2017, and 102016123926.7 filed Dec. 9, 2016, are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A device for producing fascines, said device comprising:

a plurality of conveyor screws in each case for conveying fibrous material in a respective tubular element for filling the fibrous material into tubular nets;

a distributor box, wherein the distributor box has an interior space having an infeed opening for infeeding the fibrous material, and at least one base-side opening for infeeding the fibrous material from the distributor box to the plurality of conveyor screws;

a plurality of collection containers; and at least one cellular wheel disposed in each of the plurality of collection containers.

2. The device according to claim 1, wherein the device includes four conveyor screws and the distributor box has a predefined minimum height of at least 3 or 3.5 meters, or the device includes five conveyor screws and has a predefined minimum height of at least 4 or 4.5 meters.

3. The device according to claim 1, wherein the distributor box has at least one distributor cam and/or at least one conveyor belt fastened to at least one wall in the interior space of the distributor box, wherein the at least one distributor cam and/or the at least one conveyor belt is or are disposed in such a manner so as to distribute the fibrous material that is infed through the infeed opening to the interior space of the distributor box in a direction of the at least one base-side opening.

4. The device according to claim 1, wherein the distributor box has at least one screw distributor which is disposed in an upper region of the interior space of the distributor box so as to distribute the fibrous material that is infed through the infeed opening to the interior space of the distributor box in a direction of the at least one base-side opening.

5. The device according to claim 1, wherein the distributor box has at least one filling level sensor for determining the attainment of a filling height, or for determining the filling height.

6. The device according to claim 1, wherein the device has a plurality of collection containers, wherein each of the conveyor screws is in each case disposed in a lower region of a respective one of the collection containers, and an upper side of each collection container is connected to the at least one base-side opening of the distributor box, and wherein each collection container is or comprises a trough and/or an element having a funnel-shaped cross-section.

7. The device according to claim 1, wherein each of the collection containers has a lower region in which a respective of the conveyor screws is disposed, an upper region in which two cellular wheels are disposed and which are specified to rotate in opposite directions and which on account thereof form a conveying region such that the fibrous material is conveyed in a direction from the upper region to the lower region, and a central region, wherein the central region has an outlet region of the conveying region that is formed by the cellular wheels, and wherein a distributor roller for loosening the fibrous material that is conveyed by the cellular wheels is disposed in the outlet region.

8. The device according to claim 1, wherein the distributor box has a plurality of base-side openings which in each case guide fibrous material to a respective one of the plurality of collection containers, wherein the base-side openings are in each case formed by way of at least one respective guide wall that extends at least partially into the distributor box parallel with rotation axes of the cellular wheels and terminates in a substantially centrical manner above a respective one of the cellular wheels.

9. The device according to claim 8, wherein each base-side opening is in each case formed by way of two parallel guide walls that partially run in a vertical manner and which in each case terminate in a centrical manner above one of two cellular wheels of a respective one of the collection containers.

10. The device according to claim 9, wherein neighboring guide walls and/or guide walls of neighboring base-side openings converge in an upper region of the distributor box and meet in a rounded feature, at an acute angle, or at a right angle, in a connection region within the distributor box.

11. The device according to claim 10, wherein in each case one movable element is disposed in the region of the connection regions of the guide walls.

12. The device according to claim 1, wherein each conveyor screw is assigned a sensor, which is disposed in the distributor box above the respective conveyor screw, and wherein one or more conveyor belts in the distributor box is/are in each case operable so as to be stopped, advanced, or reversed, depending on the sensors.

13. The device according to claim 12, wherein the device has four conveyor screws and two conveyor belts, and a first of the two conveyor belts is actuatable by a controller in such a manner that the first conveyor belt remains stopped when two predetermined sensors are triggered, is advanced when one of the two predetermined sensors is triggered, and is reversed when the other of the two predetermined sensors is triggered, and a second of the two conveyor belts is actuatable by the controller in such a manner that the second conveyor belt remains stopped when two other predetermined sensors are triggered, is advanced when one of the two other predetermined sensors is triggered, and is reversed when the other of the two other predetermined sensors is triggered.

14. The device according to claim 1, wherein the device has two conveyor belts which are disposed beside one another and in each case in terms of height decline from a center of the distributor box to lateral external walls of the distributor box, a gap is disposed between the conveyor belts, and a distributor roller is disposed in a region of the gap.

15. The device according to claim 1, wherein the device has a controller which is specified for starting and stopping the advance of each conveyor screw, wherein the controller upon manual starting of the advance of each conveyor screw is specified for reversing the conveyor screw for a predefined temporal period or a predefined number of revolutions, so as to thereafter automatically commence advancing.

16. The device according to claim 1, wherein the device has an installation for closing the tubular net and for severing the tubular net.

17. A method for producing fascines via a device having:

a plurality of conveyor screws in each case for conveying fibrous material in a respective tubular element for filling the fibrous material into tubular nets;

a distributor box, wherein the distributor box has an interior space having an infeed opening for infeeding the fibrous material, and at least one base-side opening for infeeding fibrous material from the distributor box to the plurality of conveyor screws;

a plurality of collection containers; and at least one cellular wheel disposed in each of the plurality of collection containers, the method comprising:

conveying fibrous material into the distributor box, infeeding the fibrous material from the distributor box to the conveyor screws, and filling the fibrous material into tubular nets by way of the conveyor screws.

* * * * *